US005137670A

United States Patent [19]

Murase et al.

[11] Patent Number: 5,137,670

[45] Date of Patent: Aug. 11, 1992

[54] POLYESTER FIBER AND PROCESS FOR MANUFACTURE

[75] Inventors: Shigemitsu Murase, Uji; Hiroshi Yokoyama, Joyo; Kinsaku Nishikawa, Uji, all of Japan

[73] Assignee: Unitika, Osaka, Japan

[21] Appl. No.: 580,756

[22] Filed: Sep. 11, 1990

[51] Int. Cl.[5] ..... D01F 6/62; D01D 5/12

[52] U.S. Cl. ..... 264/130; 264/210.7; 264/210.8; 264/211.14; 264/211.15; 428/364; 428/395

[58] Field of Search ..... 428/902, 364; 264/210.7, 210.8, 130

[56] References Cited

U.S. PATENT DOCUMENTS 4,851,172 7/1989 Rowan et al. ..... 264/130
4,973,657 11/1990 Thaler ..... 528/308.1
4,975,326 12/1990 Buyalos et al. ..... 428/373

*Primary Examiner*—George F. Lesmes
*Assistant Examiner*—Chris Raimund

[57] ABSTRACT

(1) Polyester fiber which consists substantially of polyethylene terephthalate, the fiber being characterized by strength of least 7.0 g/d, initial Young's modulus of at least 85 g/d, elongation of less that 20%, degree of crystallization $X\rho$ of at least 45% and the ratio of birefringence ($\Delta n$) and the degree of crystallization $X\rho$ from 0.38 to 0.45.

(2) Method of making polyester fiber, characterized as follows: Polyethylene terephthalate is melt spun then passed through the heated cylinder which is installed directly under the spinning die; cooled and solidified; the oil agent is imparted and the yarn is taken-up at the speed of over 2000 m/min; this is drawn to a ratio of 1.5–2.3 in at least 2-drawing stages in continuation; then heat treated; the surface temperature of the drawing rollers at the final drawing stage is kept at 220°–250° C.; a non-contact type heating plate heated to a surface temperature of 250°–500° C. is installed 200–100 mm apart from the yarn at the final drawing stage to heat the drawn yarn; the yarn is heat treated again by the heating roller and finally wound-up.

1 Claim, 1 Drawing Sheet

POLYESTER FIBER AND PROCESS FOR MANUFACTURE

FIELD OF THE INVENTION

This invention is related to polyester fiber with improved dimensional stability which is suitable for use as industrial fibers for tire reinforcement and to the method of making it.

BACKGROUND OF THE INVENTION

Polyester fiber which is represented by polyethylene terephthalate fiber is used widely for apparel and industrial materials. In recent years, requirements toward higher performance of the industrial fibers, particularly the tire-reinforcing fibers, has been heightening and fiber with good dimensional stability against heat is being desired.

Attempts to make polyester fiber of improved dimensional stability have been made in various ways. For example, in JP No. 528 - 1988 and JP No. 529 - 1988, the method in which the undrawn yarn of high orientation is made by increasing the spinning speed and then drawing in continuation in making the polyester fiber was proposed. However, the fiber which is obtained by this method has large shrinkage and the dimensional stability is not adequate.

Also, in Kokai JP No. 259620 - 1985, the method in which melt spinning is done at high speed and the yarn is taken up and then this is drawn in multiple stages to make polyester fibers of high initial Young's modulus and low shrinkage was proposed. The yarn which is obtained by this method, however, has high birefringence and has high amorphous orientation perhaps because of improper distribution of draw ratios and so the shrinkage is high and dimensional stability is inferior.

Also in Kokai JP No. 165547 - 1988, the polyester tire cord of high modulus and the method of making are described and the method in which, in making the polyester fiber, melt spinning is done at a spinning speed of over 5000 m/min and then hot drawing to a ratio of 1.2–1.8 is done is disclosed; but, this is the so called split process method and there is a problem in the cost.

Also, in Kokai JP No. 159518, an invention related to thermally stable polyester fiber is disclosed; however, the strength is low and it is not suitable as industrial fiber.

This invention is intended to make it possible to make the polyester fiber which has good dimensional stability against heat and is suitable as an industrial fiber with a high productivity.

SUMMARY OF THE INVENTION

The invention solves the above-described problem and the key points are as follows.

(1) Polyester fiber which consists substantially of polyethylene terephthalate, the fiber being characterized by strength of least 7.0 g/d, initial Young's modulus of at least 85 g/d, elongation of less that 20%, degree of crystallization $X\rho$ of at least 45% and the ratio of birefringence ($\Delta n$) and the degree of crystallization $X\rho$ from 0.38 to 0.45.

(2) Method of making polyester fiber, the method being characterized as follows: The polyester which consists substantially of polyethylene terephthalate is melt spun; the spun yarn is passed through the heated cylinder which is installed directly under the spinning die; after this, the yarn is cooled and solidified; then, the oil agent is imparted and the yarn is taken up at the speed of over 2000 m/min; this is drawn to a ratio of 1.5–2.3 in at least 2-drawing stages in continuation; then the yarn is heat treated to make the polyester fiber; in this method, the surface temperature of the drawing rollers at the final drawing stage is kept at 220°–250° C.; at the position which is 20–100 mm apart from the yarn which is being wound to the drawing roller at the final drawing stage, a non-contact type heating plate which is heated to a surface temperature of 250°–500° C. is installed to heat the drawn yarn; the yarn is heat treated again by the heating roller and finally wound-up.

DESCRIPTION OF THE PREFERRED EMBODIMENT

In the following, the invention is described in detail.

The polyester fiber of this invention is characterized first by strength of at least 7.0 g/d, initial Young's modulus of at least 85 g/d and elongation of less than 20%. By satisfying these property values, one obtains a suitable industrial fiber, particularly the rubber-reinforcing fiber which is represented by the tire cord.

As the second characteristic feature, the polyester fiber of this invention has a degree of crystallization $X\rho$ of at least 0.45 and the ratio of birefringence $\Delta n$ and degree of crystallization $X\rho$ which is 0.38–0.45.

In other words, the drawn polyester fiber of this invention has a high degree of crystallization and low degree of orientation and hence has good dimensional stability; this characteristic is maintained even when the yarn is subjected to the post process of dip treatment.

In order to improve the dimensional stability at elevated temperature, it is necessary to have a high degree of crystallization and low degree of orientation. However, if the orientation is too low, strength or initial Young's modulus is low and the fiber is not suitable as the rubber-reinforcing fibers. Thus, it is necessary to select the birefringence $\Delta n$, which is an index of the degree of orientation, and the degree of crystallization in suitable ranges and it was found that, when the degree of crystallization $X\rho$ is at least 0.45 and the ratio of birefringence $\Delta n$ and degree of crystallization $X\rho$ is 0.38–0.45, there results the fiber which is suitable as the rubber-reinforcing fiber. When these conditions are not satisfied, strength or initial Young's modulus is low or dimensional stability is inferior.

As for the polyester in this invention, polyethylene terephthalate (PET) and co-polyesters which are mainly PET, the one with a relative viscosity (measured at a temperature of 25° C. in the equal weight mixed solvent of phenol and tetrachloroethane in a concentration of 0.5 g/dl) of over 1.45, preferably over 1.50, is used. Also, in order to improve the heat resistance, it is desirable to conduct the spinning with the addition of a carboxyl end group blocking agent such as an epoxy compound.

The fiber of this invention is suitable as industrial material, particularly as the rubber-reinforcing material represented by tire cord and a total denier of 250–2000 d and filament number of 36–600 are suitable.

In the following, the method of making polyester fiber of this invention is described in detail by use of the figures.

Figure 1:
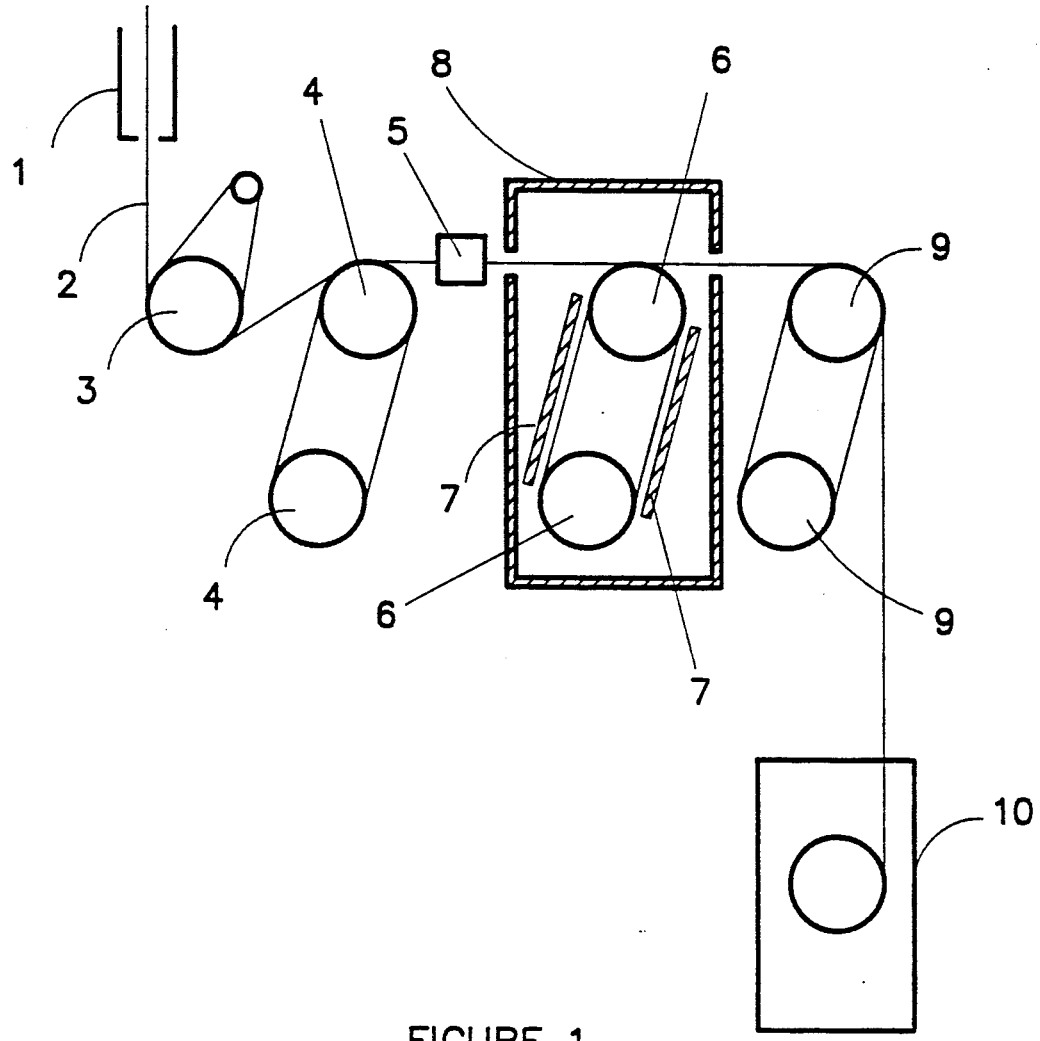
FIG. 1 illustrates a mode of application of the method of this invention.

FIG. 1 illustrates the mode of an application of the method of this invention. In FIG. 1, 1 is the spinning cylinder, 2 is the spun yarn, 3 is the take up roller, 4 is the Nelson type first drawing roller, 5 is the steam jet apparatus, 6 is the Nelson type second drawing roller, 7 is the non-contact type heating plate which is installed near the yarn which is wound to the second drawing roller, 8 is the heat box which surrounds the second draw roller 6, 9 is the heating roller, 10 is the winding apparatus.

FIGS. 2 (A) and (B) illustrate the examples of installation of the non-contact heating plate in the apparatus of FIG. 1.

In the method of this invention, the direct spin draw apparatus shown in FIG. 1 is used; the melt spun yarn is cooled and solidified and, after this, the oil agent is imparted and the yarn is taken up; this polyester undrawn yarn is drawn in multiple stages at least 2 stages in continuation without winding up the undrawn yarn and then this is heat treated in continuation and then it is wound-up.

First, following the polycondensation apparatus, the molten polyester of high viscosity is introduced directly into the spinning apparatus (not shown in the figure) or it is first made into chips of the polyester of high viscosity which is melted by extruder and this is introduced to the above mentioned spinning apparatus; melt spinning is done by the common method and the yarn is cooled to solidify; after this, the oil agent is imparted and the yarn is taken up by the take up roller 3 at a surface velocity of 2000 m/min or above. In order to achieve a uniform cooling and enhance spun yarn uniformity, it is necessary to have optimal combination of: Number of filaments, denier per filament, spinnerette hole diameter and hole arrangement, spinning temperature, length of the heated cylinder, atmospheric temperature inside the heated cylinder, length of the cooling zone, temperature and velocity of the cooling air, method of blowing the cooling air (blowing or suction from the circumferential direction is preferred), the relative viscosity of polyester, and spinning speed.

The undrawn yarn 2 is taken-up, and then the first stage of drawing is applied between the take up roller 3 and the Nelson type first drawing roller 4 to a draw ratio of 1.0–2.0. At this time, the surface temperature of take up roller 3 is set to the temperature near the PET glass transition point. Next, the yarn is again drawn using the steam jet apparatus 5 which is installed between the first drawing roller 4 and the Nelson type second drawing roller 6. It jets out the steam at the temperature of 350°–500° C., heating yarn 2 while it is drawn between the above mentioned rollers such that the total draw ratio would be 1.5–2.3. At this time, the surface temperature of the first drawing roller 4 is normally set to the range of the glass transition temperature of the unheated undrawn yarn.

In continuation, the drawn yarn is heat-treated by the heated roller 9 and then it is taken up by the winding apparatus 10.

The first characteristic feature of the method of this invention is that the take-up speed of the undrawn yarn is above 2000 m/min, preferably above 2300 m/min. If the take up speed is slower than this, the draw ratio has to be larger in order to make the elongation less than 20% and then the degree of orientation in the drawn fiber is too high and one cannot obtain the polyester fiber of good dimensional stability.

The second characteristic feature of the method of this invention is that the draw ratio is kept in the range of 1.5–2.3. If the draw ratio is smaller than this range, one can obtain only the fiber which has inadequate strength or initial Young's modulus; in reverse, if it is greater than this range, degree of orientation is too high and one cannot obtain the polyester fiber of good dimensional stability; in addition, feathering occurs and the workability is poor.

Figure 2A:
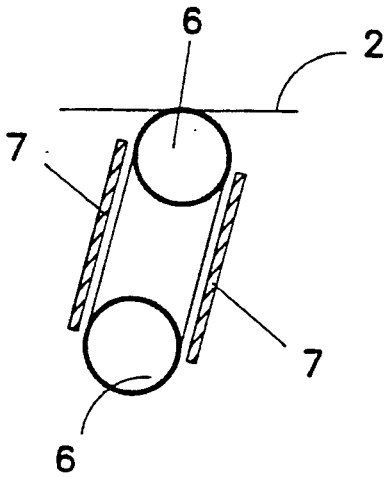
FIGS. 2(A) and (B) illustrate examples of installation of the non-contact type heating plate in the apparatus of FIG. 1.
Figure 2B:
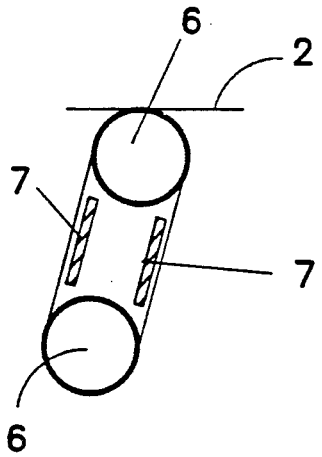

The third characteristic feature of the method of this invention is that during heat treatment of drawn yarn, it is uniformly heated by the heated second drawing roller 6 and by the non-contact type heating plate 7 installed near the yarn on the same roller and, in addition, heat treatment is given by the heating roller 9. The above mentioned non-contact type heating plate 7 in the method of this invention is installed near the yarn which is wound on the second drawing roller 6 and its effective width must cover at least the yarn from the first winding to the last winding which is wound on the second drawing roller 6 and it is preferably 150–250 mm although this depends on the effective length of the second drawing roller 6 and the number of yarn winding on the second drawing roller 6. The effective length is preferably 300–700 mm although this also depends on the diameter of the second drawing roller 6 and the position of installation (distance between the centers of rollers). As to the position of its installation, it is located 20–100 mm from the yarn which is wound on the second drawing roller 6; it can be either the outer side of the yarn wound as shown in FIG. 2(A) or the inside of the yarn wound as shown in FIG. 2(B); however, for making the apparatus smaller and for the workability, installation inside as shown in FIG. 2(B) is preferred.

For the heat treatment of drawn yarn in the method of this invention, the surface temperature of second drawing roller 6 is kept at 220°–250° C. although this depends also on the total denier of the yarn and drawing speed. If the surface temperature of the second drawing roller 6 is lower than this range, the heat treatment of yarn is not adequate and so the degree of crystallization is low; if the temperature is higher than this range, the yarn melts and then sticks to the second drawing roller. This is not desirable. Also, the surface temperature of the non-contact type heating plate 7 is kept at 250°–500° C. However, the specific temperature used depends on the total denier of the yarn and drawing speed. If the surface temperature of the non-contact type heating plate 7 is lower than this range, the yarn on the second drawing roller cannot be heated sufficiently; if it is higher than this range, the yarn melt-sticks to the second drawing roller and this is not desirable.

As to the number of drawing stages, it is necessary to make multiple stages of at least 2 stages. With a one stage drawing, adequate drawing cannot be done and fiber of high strength cannot be obtained. Also, as to the means of heating the yarn at the final drawing stage, a steam jet apparatus which jets out the steam at a temperature of 350°–500° C. or a heating plate of surface temperature of 150°–240° C. is used.

For polyester fiber of high strength made by the high-speed direct spin-draw method, a non-contact type heating plate is installed near the yarn which is wound on the drawing roller of the final drawing stage to heat the yarn and, in continuation, the yarn is heat treated by the heating roller. According to the method of this invention, one can obtain effective heat treatment without setting the surface temperature of the drawing roller of the final drawing stage at a high temperature which would cause the melt sticking of yarn and, consequently, it is possible to make the polyester fiber which has high degree of crystallization, suitable degree of orientation and good dimensional stability.

In the following, the invention is described in detail by use of the examples of application.

Also, in this invention, the methods of measuring the property values were as follows.

Strength, Elongation and Initial Young's Modulus

Measurements were made in accordance with JIS L 1013.

Degree of Crystallization

In accordance with JIS L 1013, density $\rho$ was measured by the density gradient tube which was prepared with carbontetrachloride and ligroin and calculation was done by the following equation.

$$X\rho = \frac{\rho - \rho a}{\rho c - \rho} \times \frac{\rho c}{\rho}$$

($\rho a = 1.335$ g/cc, $\rho c = 1.455$ g/cc)

Birefringence

Using a polarized microscope equipped with Bereck compensator and using tricresyl phosphate as the dipping liquid, measurement was made.

Dry Heat Shrinkage

In accordance with JIS L 1013, sample was heat treated at 180° C. for 30 minutes under no tension and the measurement was made.

Crystal Size

This was obtained by use of Scheller's equation from the half width value of the intensity distribution curve of the equatorial scanning of (010), (100), (105) resulting in X ray wide angle scatter.

Long Period

This was obtained by use of Bragg's equation from the measurement of the Small-angle X-ray scattering maxima in the meridional direction.

EXAMPLE 1

Chip of polyethylene terephthalate of relative viscosity 1.58 was fed to the extruder of the melt spinning machine at the spinning temperature of 295° C. Extrusion was done from the spinning die having 192 spinning holes with a diameter of 0.5 mm. Extrudate was passed through the heated cylinder of 9 cm length at the temperature of 300° C.; after this, it was cooled to solidification in a cylindrical cooling apparatus of 30 cm length to which cooling air of 18° C. temperature was fed at a speed of 36 m/min.; then, the spinning oil agent was applied; after this, it was taken up by the take up roller which was heated to 70° C.; next, drawing was done in continuation to obtain the draw yarn of 1000 d/192 f.

Drawing was conducted in 2 stages. Between the take up roller at 70° C. and the unheated first drawing roller, the first stage drawing was done to a draw ratio of 1.20; next, between the first drawing roller and heated second drawing roller (Nelson type), the second stage drawing was done using a steam jet apparatus installed 15 cm downstream from the first drawing roller. The steam jets out at 450° C. temperature. Positioned 5 cm away from the outer side from the yarn wound on the second drawing roller, the non-contact type heating plate of effective width 20 cm and effective length 60 cm was installed to heat the drawn yarn on the second drawing roller and, in continuation, heat treatment was done by the heated roller (Nelson type) at 200° C.

For this process, the speed of each roller, total draw ratio, temperature and workability are shown in Table 1 and the yarn properties of the drawn yarn obtained are shown in Table 2. (In No. 8 and No. 10, yarn melt-stuck onto the second drawing roller and yarn breakage occurred frequently and, therefore, measurement of the yarn properties was omitted).

Also, micro structure was measured for the No. 2, 4, 5 and 7 drawn yarns. The results are also shown in Table 2.

TABLE 1

| | Speed m/min. | | | | | Temperature, °C. | | | |
|---|---|---|---|---|---|---|---|---|---|
| No. | Take-up Roller | Second Drawing Roller | Heating Roller | Winding Up | Total Draw Ratio | Second Draw Roller | Non-contact Heating Plate | Heating Roller | Workability* |
| 1 | 1800 | 3960 | 3920 | 3810 | 2.2 | 240 | 400 | 200 | ○ |
| 2 | " | 4320 | 4280 | 4150 | 2.4 | " | " | " | ○ |
| 3 | 2400 | 3360 | 3320 | 3230 | 1.4 | " | " | " | ○ |
| 4 | " | 4560 | 4510 | 4380 | 1.9 | " | " | " | ○ |
| 5 | " | 5280 | 5230 | 5070 | 2.2 | " | " | " | ○ |
| 6 | " | 5760 | 5710 | 5480 | 2.4 | " | " | " | |
| 7 | " | 5280 | 5230 | 5020 | 2.2 | 200 | " | " | ○ |
| 8 | " | " | " | " | " | 260 | " | " | X |
| 9 | " | " | " | " | " | 240 | 200 | " | ○ |
| 10 | " | " | " | " | " | " | 600 | " | X |
| 11 | " | " | " | 4920 | " | " | 400 | Unheated | |
| 12 | 2700 | 5400 | 5350 | 5140 | 2.0 | 250 | 450 | 200 | ○ |
| 13 | 3100 | 5580 | 5520 | 5300 | 1.8 | " | " | " | ○ |

*○ = Good; X.= Poor

NOTE: The No. with a circle around it refers to the examples of application and others are the comparative examples.

TABLE 2

| No. | Strength g/d | Elongation % | Initial Young's Modulus g/d | Xρ | Δn | Δn Xρ | Crystal Size A° (010) | (100) | (105) | Long Period A° |
|---|---|---|---|---|---|---|---|---|---|---|
| 1 | 8.1 | 12.7 | 96 | 0.446 | 0.195 | 0.44 | — | — | — | — |
| 2 | 8.3 | 10.4 | 101 | 0.463 | 0.214 | 0.46 | 49 | 34 | 69 | 139 |
| 3 | 6.8 | 22.7 | 79 | 0.446 | 0.165 | 0.37 | — | — | — | — |
| 4 | 8.0 | 11.2 | 93 | 0.496 | 0.214 | 0.43 | 64 | 42 | 74 | 151 |

TABLE 2-continued

| No. | Strength g/d | Elongation % | Initial Young's Modulus g/d | Xρ | Δn | Δn Xρ | Crystal Size A° (010) | (100) | (105) | Long Period A° |
|---|---|---|---|---|---|---|---|---|---|---|
| 5 | 8.1 | 11.2 | 100 | 0.505 | 0.218 | 0.44 | 60 | 36 | 72 | 148 |
| 6 | 8.3 | 9.4 | 107 | 0.513 | 0.225 | 0.47 | — | — | — | — |
| 7 | 7.1 | 13.2 | 94 | 0.463 | 0.217 | 0.48 | 62 | 39 | 74 | 150 |
| 9 | 7.4 | 12.7 | 95 | 0.466 | 0.217 | 0.48 | — | — | — | — |
| 11 | 7.6 | 12.4 | 86 | 0.429 | 0.207 | 0.48 | — | — | — | — |
| 12 | 7.8 | 11.8 | 103 | 0.530 | 0.217 | 0.41 | — | — | — | — |
| 13 | 7.2 | 11.3 | 100 | 0.538 | 0.215 | 0.40 | — | — | — | — |

EXAMPLE 2

Next, the above mentioned No. 2, 4, 5 and 7 drawn yarns, were made into dip cord by the following process and the strength and dry heat shrinkage of the dip cord were measured.

To the above said drawn yarn, a downward twisting of 49/10 cm in Z direction was applied by use of a Ring twisting machine; two yarns were joined and the upward twisting of 49/10 cm was applied in S direction to make the greige cord.

Next, using a Litzler dipping machine, the following dip solution was applied at the 3.5% level and the coated cord was first subjected to 160° C. atmosphere for 60 seconds, then 240° C. for 120 seconds. The dip tension was set at 1.10 kg/cord to provide the intermediate elongation of 3.6±0.2%, under a load of 4.5 kg.

Dip Solution

To 1 weight part of the initial condensation product obtained by reacting resorcin and formaldehyde in a 1:1.2 mol ratio, Gentac Latex (trade name of General Tire Co.) of solid content 20 weight % was mixed by 4.3 weight parts in terms of the solid content; pH was adjusted to 9.5 with sodium hydroxide; this was mixed with Vulcabond E (trade name of Vulnax Co.) in 83:17 weight ratio to obtain the dip solution.

TABLE 3

| No. | Strength (Kg) | Dry Heat Shrinkage (%) |
|---|---|---|
| 2 | 15.0 | 5.5 |
| 4 | 13.7 | 3.2 |
| 5 | 14.1 | 3.3 |
| 7 | 12.1 | 4.7 |

By this invention, it is possible to make polyester fiber which has good dimensional stability when heated and is suitable as industrial fiber for rubber-reinforcement in a high productivity.

What is claimed:

1. A continuous spin-draw process for production of polyester yarn consisting substantially of polyethylene terephthalate and having a degree of crystallinity (Xρ) of at least 45%;

said process comprising melt spinning polyester which consists substantially of polyethylene terephthalate through a spinning die to produce spun yarn; passing the spun yarn through a heated cylinder installed directly adjacent the face of the spinning die; solidifying the spun yarn by cooling; applying an oil agent; passing the spun yarn to a take up roller at a speed of at least 2000 meters per minute; then continuously drawing spun yarn to a draw ratio of 1.5–2.3 in at least 2 continuous stages; then heat treating the yarn; then winding up the yarn;

said drawing step comprising multiple drawing stages of at least two stages wherein said spun yarn is passed from the takeup roller to a first pair of drawing rollers, then to a final pair of drawing rollers, then to a pair of heat treatment rollers and then to yarn takeup means; the surface temperature of said final pair of drawing rollers being from 220° to 250° C.; a non-contact type heating plate whose surface temperature is heated to 250° to 500° C. is positioned 20 to 100 mm from the yarn which is wound about the final pair of drawing rollers; whereby the drawn yarn is uniformly heated by said final pair of drawing rollers, said non-contact type heating plate, and said pair of heat treatment rollers.

* * * * *